United States Patent [19]

Shimoyama et al.

[11] 4,439,251

[45] Mar. 27, 1984

[54] NON-ORIENTED ELECTRIC IRON SHEET AND METHOD FOR PRODUCING THE SAME

[75] Inventors: Yoshiaki Shimoyama; Ichiro Tachino; Shigenobu Koga, all of Kitakyushu, Japan

[73] Assignee: Nippon Steel Corporation, Tokyo, Japan

[21] Appl. No.: 286,754

[22] Filed: Jul. 27, 1981

Related U.S. Application Data

[63] Continuation of Ser. No. 76,734, Sep. 18, 1979, abandoned, which is a continuation-in-part of Ser. No. 47,995, Jun. 13, 1979, abandoned.

[30] Foreign Application Priority Data

Jun. 16, 1978 [JP] Japan ..... 53-72097

[51] Int. Cl.[3] ..... C04B 35/00

[52] U.S. Cl. ..... 148/31.55; 75/123 B; 75/123 L; 75/124

[58] Field of Search ..... 148/111, 120, 31.55, 148/110, 112, 113; 75/123 B, 123 L, 124 B

[56] References Cited

U.S. PATENT DOCUMENTS

| | | | |
|---|---|---|---|
| 3,770,517 | 11/1973 | Gray et al. | 148/111 |
| 3,827,924 | 8/1974 | Takechi et al. | 75/123 B |
| 3,873,381 | 3/1975 | Jackson | 148/112 |
| 3,897,245 | 7/1975 | Sauas | 75/124 B |
| 3,950,191 | 4/1976 | Ito et al. | 75/123 B |
| 4,030,950 | 6/1977 | Shilling et al. | 148/113 |
| 4,066,479 | 1/1978 | Shimoyama et al. | 148/111 |
| 4,115,161 | 9/1978 | Datta | 148/111 |
| 4,160,681 | 7/1979 | Miller | 148/111 |

*Primary Examiner*—John P. Sheehan

*Attorney, Agent, or Firm*—Wenderoth, Lind & Ponack

[57] ABSTRACT

A non-oriented magnetic material consisting essentially of ≦0.065% C, ≦0.10% Al, 0.31 to 3.15% Si, ≦0.020% O, ≦0.01% N and B present in such amounts that the ratio of B/N is in the range of 0.5 to 2.50. The non-oriented magnetic material of this invention is produced by hot rolling a material of the above composition, subjecting the hot-rolled sheet to at least one cold-rolling step with intermediate annealing followed by a continuous annealing step and optionally a reannealing step to produce a non-oriented magnetic material.

4 Claims, 3 Drawing Figures

NON-ORIENTED ELECTRIC IRON SHEET AND METHOD FOR PRODUCING THE SAME

CROSS REFERENCE TO RELATED APPLICATION

This invention is a continuation of application Ser. No. 76,734, filed Sept. 18, 1979 now abandoned, which in turn is a continuation-in-part of application Ser. No. 47,995, filed June 13, 1979 now abandoned.

BACKGROUND OF THE INVENTION

1. Field of the Invention

The present invention relates to a method for producing an electric iron sheet, more particularly a non-oriented iron sheet containing no more than 3.5% silicon, and when containing said silicon, it is present in a stable form.

2. Description of the Prior Art

Among electric iron sheets as soft magnetic materials there are the following kinds: a grain oriented silicon steel sheet, which is composed of a recrystallized collective texture crystallographyically expressed as (110) [001] and has the (110) plane on the rolling plane and a [001] orientation arranged in the rolling direction; a non-oriented silicon steel sheet having a recrystallized texture, in which the orientation does not come into question; and an extremely low carbon magnetic material containing no silicon or a very small amount thereof. These electric sheets are used as iron cores for electric devices and the like in accordance with their respective properties.

For instance, a grain oriented silicon steel sheet is widely used for transformers and large capacity electromotors, because it has excellent magnetic properties, because it is very easily magnetizable in the rolling direction, that is, in the [001] orientation; the core loss value is very low and the permeability is high. On the other hand, a non-oriented silicon steel sheet is used for small-sized electro-motors, relays and the like, because a processing of high efficiency can be carried out on account of its good workability, though it is somewhat inferior to the grain oriented silicon steel sheet in magnetic properties. Further, an extremely low carbon magnetic material is widely used for small-sized direct current electro-motors, electro-motors for household electric devices and the like, because it has adequate magnetic properties and is low in production cost.

In general, in the case of a so-called extremely low carbon magnetic material, in which the silicon content is below 2%, Al is added in order to improve the magnetic properties. This is to effect the improvement of magnetic properties by causing AlN to precipitate, but the effective amount of Al to be added should be more than 0.1%.

Consequently, because of the need to add Al in the amount previously mentioned, the production of an extremely low carbon magnetic material possessing the required magnetic properties is expensive and its cost is expected to rise. On the other hand, in the case of an extremely low carbon magnetic material, when the Al content is less than 0.1%, the precipitation temperature of AlN becomes lower, the precipitates become fine and the core loss is remarkably deteriorated.

SUMMARY OF THE INVENTION

An object of the present invention is to provide an extremely low carbon magnetic material having improved magnetic properties, particularly in respect to the core loss, and which can be produced inexpensively.

Another object of the present invention is to provide an excellent non-oriented electric iron sheet for obtaining low core loss by the addition of boron.

Still another object of the present invention is to provide a method for producing an extremely low carbon, non-oriented electric iron sheet, in which nitrogen usually contained in steel and added boron is controlled within certain range.

BRIEF DESCRIPTION OF THE DRAWINGS

Other objects of the present invention will become clear from the following descriptions and the accompanying drawings.

DETAILED DESCRIPTION

Figure 1A:
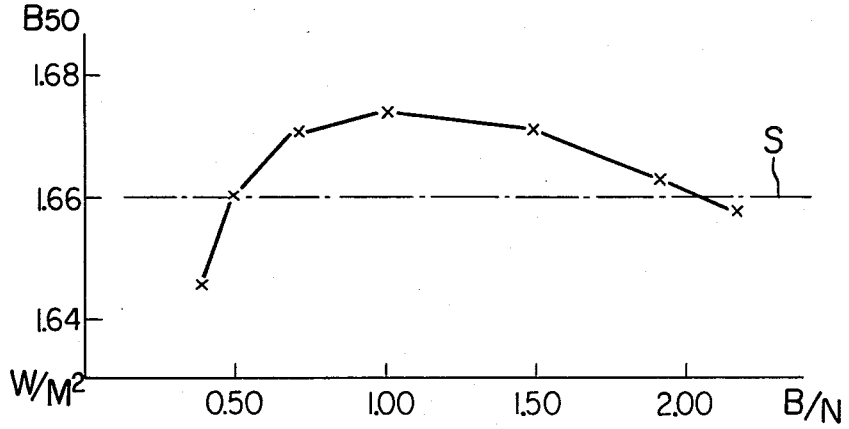
FIG. 1 shows the relationship between the ratio of B/N and the magnetic properties.

The present invention has succeeded in improving the magnetic properties, particularly the core loss of a so-called extremely low carbon magnetic material, which has a silicon content of no more than 3.5% and preferably no more than 2.0%, by a simple means and is characterized by obtaining a non-oriented electric iron sheet excellent in magnetic properties by subjecting a steel slab, which consists essentially of $\leqq 0.065\%$ C, $\leqq 3.5\%$ Si, $\leqq 0.10\%$ Al, $\leqq 0.020\%$ O, the ratio of B/N being in a range of 0.50 to $2.50 \leqq 0.0100\%$ N, and the rest being Fe and unavoidable impurities, to processing treatments according to the usual method.

Another feature of the present invention is characterized by obtaining a high grade non-oriented electric iron sheet having excellent magnetic properties rather than a commercial grade non-oriented electric iron sheet above described by subjecting a sheet further containing less than 3.5% silicon in addition to the above described composition to the usual processing treatments.

There has been already published a method for improving the magnetic properties by controlling B within the steel in a process of producing a grain oriented silicon steel sheet, which contains silicon and Al. This has been published in many official bulletins, for instance, in Japanese laid open patent Nos. 153825/77 or 12615/77 and the like.

However, the addition of B to the steel according to these known publications is regarded as having the objective of producing a single-oriented silicon steel sheet excellent in magnetic properties which has crystal grains of a (110) [001] collective texture as expressed by the Miller's Index.

In general, the improvement of the magnetic properties of a grain oriented silicon steel sheet by the addition of B aims at forming a (110) [001] collective texture by accelerating the secondary recrystallization during the final annealing in a so-called silicon steel sheet which contains silicon in an amount of more than 2.2% and less than 4.5%.

As a result of various investigations made by the inventors of the present invention on the means for improving the magnetic properties of an extremely low carbon non-oriented magnetic material by simple means, that is, a magnetic material containing no silicon or silicon in amounts of no more than 3.5% they have discovered that an excellent non-oriented electric iron sheet low in core loss may be obtained by balancing the amount of nitrogen contained in the steel with the amount of boron added thereto.

The present inventors have studied the change of magnetic properties and recovery methods when the content of Al is decreased less than 0.1% in a so-called non-oriented silicon iron sheet, containing more than 2.0% Si, and found out that a high-grade non-oriented electric iron sheet may be produced, which is more excellent in magnetic properties than a commercial grade electric iron sheet containing 2.0% Si. This is achieved by controlling the composition such that B/N 0.50–2.50, even if the Al content is less than 0.1%.

The steels used as magnetic materials for the present invention are prepared by melting the steel in a refining furnace, such as converter, an electric furnace and the like and further refining the steel in a vacuum refining furnace, as the occasion calls, so that the carbon content may be reduced to less than 0.065%, then adding silicon, boron and the like as required and regulating a steel slab composition as is specified by the present invention in the following.

In regard to the steel slab composition, C is limited to be below 0.065%, preferably not more than 0.015%. As C in the steel exerts a deteriorative influence on the magnetic properties of the steel, the steel slab is usually decarburized finally at the finishing annealing, though the decarburization treatment is sometimes omitted according to the property levels or uses of the products.

However, if the carbon content exceeds the above-described limitation, sufficient decarburization at the finishing annealing step becomes difficult and the annealing must be conducted for a long time to attain the desired decarburization.

Si is generally present in an amount of more than 2.2% for improving the magnetic properties in a high grade magnetic steel sheet, but in the present invention Si is not present in the steel in amounts no more than 3.5%, because the present invention aims at the production of a low priced non-oriented electric iron sheet.

Furthermore, a large quantity of Al is generally added to a so-called high-grade non-oriented iron sheet containing Si in amounts more than 2.0%. The object is the improvement of magnetic properties by precipitating AlN at high temperatures and the effective amount of Al to be added must more than 0.150%.

Herein, when the Al content is below 0.150%, the core loss value becomes poor, but even in the case of relaxing the restriction on an amount of Al to be added, it is possible to obtain a high-grade non-oriented electric iron sheet containing more than 2.0% Si, and up to 3.5% Si by satisfying the conditions wherein B/N 0.50–2.50.

Al is used for deoxidizing the steel, but should not be contained in an amount of more than 0.10%. When the Al content is more than 0.10%, it results not only in a rise in cost, but also reduces the magnetic properties of the steel, even when boron is added as mentioned above.

Oxygen acts to deteriorate the magnetic properties and further causes an unnecessary consumption of boron. Therefore, the oxygen content is to be regulated to less than 0.020%, preferably not more than 0.005%.

The boron in the steel of the present invention should be balanced with the amount of nitrogen contained in the steel within a certain range, that is, the boron should be in the steel such that the ratio is within the range of 0.50 to 2.50 and preferably 0.65–1.50. If the ratio of B/N is below 0.50, the effects of adding boron cannot be attained; namely, a favorable core loss level after the finishing annealing and the reannealing step.

On the other hand, when the B/N ratio is higher than 2.50 the effective improvement in magnetic properties can not be achieved in proportion to the boron added with the result being that the cost of producing the non-oriented steel material is raised. Besides, the deterioration of mechanical properties is also induced.

Figure 1B:
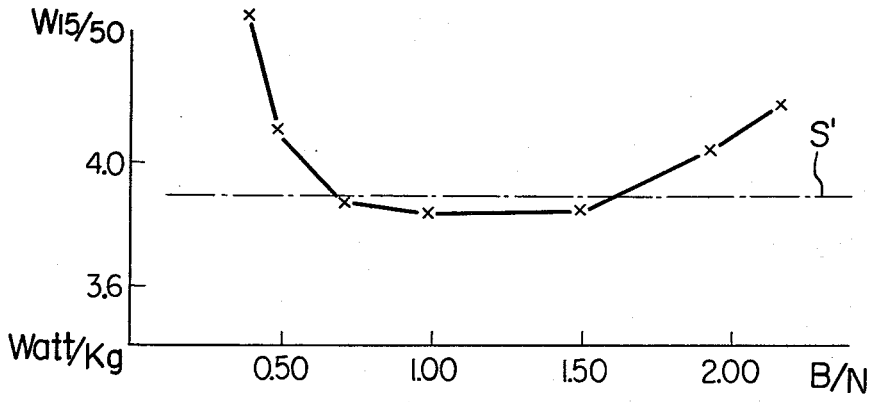

FIGS. 1(*a*) and 1(*b*) shows the relationship between the ratio of B/N and the magnetic properties, in which the X-axis shows the ratio of B/N, while the Y-axis shows the gauss values and core loss values, and further the solid line shows the material of the present invention in which the Si content is 2% and the finishing annealing is carried out at 925° C. for 45 seconds. As is seen from FIGS. 1(*a*) and 1(*b*), the material of the present invention is more excellent than the reference material in both the gauss values and the core loss values, while if the ratio of B/N is below 0.50 and higher than 2.50, the magnetic properties are unfavorable.

The amount of nitrogen in the steel must be limited to not more than 0.0100%, and preferably not more than 0.0045%.

When the amount of nitrogen is more than 0.0100%, it induces a deviation from the present invention because it amounts to a rise in cost because of the necessity of increasing the B in the steel.

The steel prepared in a refining furnace having the composition described above, is then cast to form steel slabs by a continuous casting process or cast in a mold to form steel ingots, which are further bloomed to steel slabs. These steel slabs are then hot-rolled to an intermediate guage. There is no need of forcing special conditions on the hot-rolling. The hot-rolling may be carried out under the same rolling conditions as in usual steel slabs. For instance, the slabs are heated to a temperature in the range of 1150° to 1330° C. and hot rolled.

The thus-obtained hot-rolled sheets are pickled and then subjected to a simple cold-rolling or plural cold-rollings with an intermediate annealing between them, to obtain the final gauge. The cold-rolled steel sheets having the final gauge are then annealed.

The C content of the sheet of the present invention, after the decarburization annealing, is less than 30 ppm, preferably less than 25 ppm. And the hot rolled sheet is also subjected to an annealing in the present invention.

The above-described annealing can also serve simultaneously as a strain-relieving annealing. Therefore, the annealing temperature should lie at a temperature in the range of 700° to 850° C., preferably at about 800° C. The atmosphere is not specially specified.

The method of producing a non-oriented electric iron sheet is as above described, and the non-oriented electric iron sheet obtained by the method of the present invention shows an excellent core loss level at the final annealing.

Figure 2:
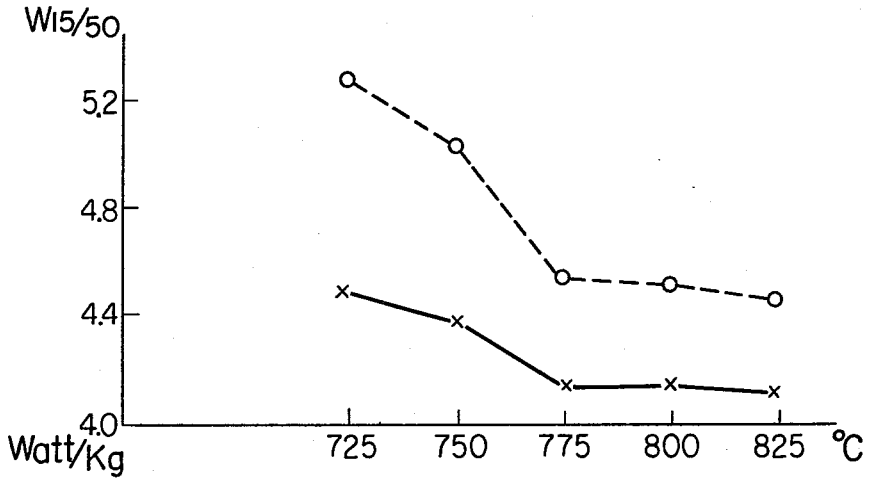
FIG. 2 shows the relationship between the reannealing temperatures and the core loss values.

One example of a steel sheet having 0.80% Si is shown in FIG. 2 in which the X-axis shows the reannealing temperature, while the Y-axis the core loss values, and further the solid line shows the material of the present invention, while the dotted line the reference material. As is seen from FIG. 2, the material of the present invention shows a core loss level lower than that of the reference material, extending over the whole temperature range of annealing and an excellent core loss at the lower temperature range.

Figure 3:
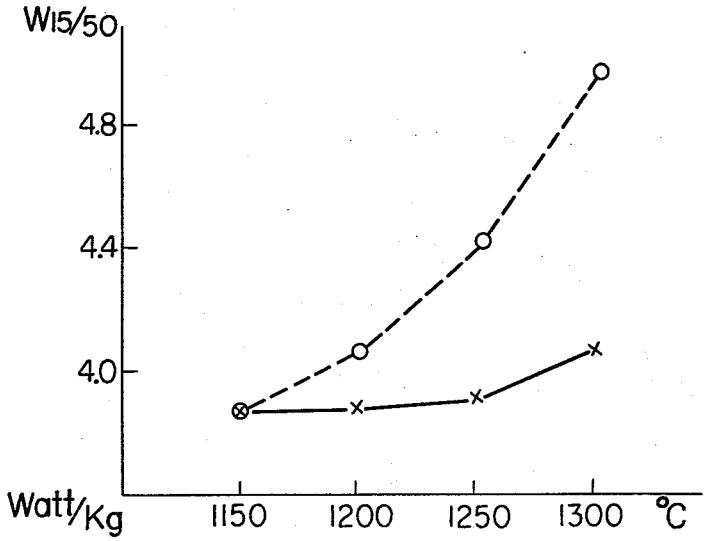
FIG. 3 shows the relationship between the heating temperature for hot-rolling and the core loss values.

FIG. 3 shows the relationship between the core loss values and the heat temperature for hot rolling, and demonstrates that the material of this invention is more excellent than the reference material is showing excellent core loss even at higher heat temperature levels during hot rolling.

EXAMPLE 1

A steel slab (A) and (B) having the composition as shown in Table 1, which has been prepared by melting in a converter, refining in a vacuum degassing vessel and casting by a continuous casting process, were heated to 1200° C. in a heating furnace, then hot-rolled to a thickness of 2.7 mm and thereafter cold-rolled to a thickness of 0.5 mm after pickling. The thus-obtained cold-rolled sheets were subjected to a continuous annealing at a temperature of 750° C. for 60 seconds. The results of the measurements of the magnetic properties made after this annealing are shown in Table 2.

TABLE 1

| Composition (%) | C | Si | Mn | P | S | N | Al | O | B | B/N |
|---|---|---|---|---|---|---|---|---|---|---|
| A | 0.0040 | 0.31 | 0.19 | 0.016 | 0.007 | 0.0030 | 0.025 | 0.0056 | 0.004 | 1.33 |
| B | 0.005 | 0.30 | 0.22 | 0.020 | 0.006 | 0.0025 | 0.015 | 0.0061 | 0.0002 | — |

TABLE 2

| | W 10/50 | W 15/30 | $B_{25}$ | $B_{50}$ |
|---|---|---|---|---|
| A | 3.58 | 7.67 | 1.67 | 1.76 |
| B | 4.91 | 10.53 | 1.65 | 1.74 |

The electric iron sheet (A) obtained by the method of the present invention shows excellent magnetic properties, in spite of the Al content being 0.025%. On the other hand, the magnetic properties of the reference material (B) was not favorable.

EXAMPLE 2

Steel slabs (C) and (D) having the composition shown in Table 3 prepared by melting in a converter, refining in a vacuum degassing vessel and casting by a continuous casting process, were further heated to 1200° C. in a continuous heating furnace and then hot-rolled to a thickness of 2.3 mm. The thus-obtained hot-rolled sheets were cold-rolled to a thickness of 0.50 after pickling.

Thereafter, the cold-rolled sheets were subjected to a finishing annealing in a continuous furnace under the conditions of 775° C. for 60 seconds and further subjected to a reannealing for 2 hours at a holding time of 750° C. and 800° C., respectively. The results of the measurements of the magnetic properties of the thus-treated sheets are shown in Table 4.

TABLE 3

| | C | Si | Mn | P | S | N | Al | O | B | B/N |
|---|---|---|---|---|---|---|---|---|---|---|
| C | 0.005 | 0.73 | 0.16 | 0.026 | 0.006 | 0.0021 | 0.018 | 0.0053 | 0.0022 | 1.05 |
| D | 0.004 | 0.78 | 0.21 | 0.018 | 0.005 | 0.0030 | 0.207 | 0.0042 | 0.0003 | — |

TABLE 4

| | C (Present invention) | | D (Reference material) | |
|---|---|---|---|---|
| | W 15/50 | $B_{50}$ | W 15/50 | $B_{50}$ |
| After finishing annealing | 7.00 | 1.74 | 7.43 | 1.74 |
| Reannealing (750° C.) | 4.45 | 1.70 | 5.05 | 1.72 |
| Reannealing (800° C.) | 4.09 | 1.70 | 4.55 | 1.71 |

The material C obtained by the present invention is superior to the reference material (D) in the iron loss values in any cases of heat treatments.

Thus, the material obtained by the present invention exhibits a favorable core loss level in spite of the inexpensive cost of the materials, in which Al has been used only for deacidizing.

As it is made possible by the present invention to provide the iron material with an excellent core loss of a practical level by reannealing at a low temperature, depending little on the reannealing temperature, as is clearly seen from FIG. 1, the permissible treating temperature range is wide and the operation is easy, whereby products of stabilized qualities can be obtained.

Further, the fact that the excellent core loss values can be obtained by heat treatments at low temperatures as above mentioned, brings about the further advantages that energy can be saved, and such troubles as sticking and peeling-off of the film, which are easily caused by the heat treatments at a high temperature, can be prevented.

EXAMPLE 3

Sheet slabs (E) and (F) having the composition as shown in Table 5, prepared by melting the steel material in a converter, refining in a vacuum degassing vessel and casting by a continuous casting process, were further heated to 1200° C. in a heating furnace and then hot-rolled to a thickness of 2.3 mm. The thus-obtained hot-rolled sheets were cold-rolled to a thickness of 0.50 mm after pickling.

Thereafter, the cold-rolled sheets were subjected to a decarburizing annealing in a decarburizing furnace under conditions of 775° C. for 60 seconds and wherein $PH_2O/PH_2=0.30$ in an oxidizing atmosphere. The decarburizing sheets were further subjected to a recrystallizing annealing under the condition of 900° C. for 30 seconds, and the results of the magnetic properties measurements are shown in Table 6.

TABLE 5

| | C | Si | Mn | P | S | N | Al | O | B | B/N |
|---|---|---|---|---|---|---|---|---|---|---|
| E | 0.006 | 1.66 | 0.27 | 0.029 | 0.007 | 0.0027 | 0.0023 | 0.0031 | 0.0020 | 0.74 |

TABLE 5-continued

| | C | Si | Mn | P | S | N | Al | O | B | B/N |
|---|---|---|---|---|---|---|---|---|---|---|
| F | 0.005 | 1.63 | 0.25 | 0.020 | 0.008 | 0.0025 | 0.285 | 0.0029 | — | — |

TABLE 6

| | $W_{10/50}$ | $W_{15/50}$ | $B_{25}$ | $B_{50}$ | Aging deterioration ratio (150° C. 1,000 hrs.) |
|---|---|---|---|---|---|
| E | 2.06 | 4.60 | 1.59 | 1.68 | 0.5% |
| F | 2.13 | 4.78 | 1.58 | 1.67 | 0.7% |

The material (E) obtained by the present invention has superior magnetic properties compared with the reference material (F) in spite of a low Al content, i.e.; less than 1/10 of Al.

EXAMPLE 4

A slab (G) and (H) having the composition as shown in Table 7, prepared by melting the steel material in a converter, refining in a vacuum degassing vessel and casting by a continuous casting process, was heated to 1150° C. in a heating furnace, then hot-rolled to a thickness of 2.7 mm and thereafter cold-rolled to a thickness of 0.50 mm after pickling. The thus-obtained cold-rolled sheet was subjected to a continuous annealing at a temperature at 925° C. for 45 seconds after the C content was less than 20 ppm by the decarburizing annealing and further subjected to a reannealing for 2 hours as a holding time at 750° C. The result of the measurements of the magnetic properties of the thus-obtained sheet was as shown in Table 8.

The material (G) obtained by the present invention has superior magnetic properties compared with the reference material (H) in spite of the low Al content.

TABLE 7

| | C | Si | Mn | P | S | N | Al | O | B | B/N |
|---|---|---|---|---|---|---|---|---|---|---|
| G | 0.004 | 2.05 | 0.60 | 0.018 | 0.006 | 0.0021 | 0.018 | 0.0030 | 0.0023 | 1.10 |
| H | 0.005 | 1.90 | 0.63 | 0.022 | 0.007 | 0.0025 | 0.243 | 0.0025 | — | — |

TABLE 8

| | After Finishing Annealing | | Reannealing | |
|---|---|---|---|---|
| | $W_{15/50}$ | $B_{50}$ | $W_{15/50}$ | $B_{50}$ |
| G | 3.85 | 1.67 | 3.35 | 1.67 |
| H | 3.90 | 1.66 | 3.50 | 1.66 |

EXAMPLE 5

A sheet slab (I) and (J) having the composition shown in Table 9, prepared by melting the steel material in a converter, refining in a vacuum degassing vessel and casting by a continuous casting process, was heated to 1150° C. in a heating furnace, then hot-rolled to a thickness of 2.3 mm and thereafter cold-rolled to a thickness of 0.50 mm after pickling. The thus-obtained cold-rolled sheet was subjected to a continuous annealing at a temperature of 1000° C. for 60 seconds, after the C content was less than 25 ppm by the decarburizing annealing. The result of the measurement of the magnetic properties of the thus-obtained sheet was shown in Table 10. The material (I) obtained by the present invention shows better magnetic properties than the reference material.

TABLE 9

| | C | Si | Mn | P | S | N | Al | O | B | B/N |
|---|---|---|---|---|---|---|---|---|---|---|
| I | 0.005 | 3.15 | 0.18 | 0.019 | 0.005 | 0.0030 | 0.025 | 0.0028 | 0.0025 | 0.80 |
| J | 0.004 | 2.91 | 0.21 | 0.022 | 0.005 | 0.0035 | 0.348 | 0.0025 | — | — |

TABLE 10

| | $W_{10/50}$ | $W_{15/50}$ | $B_{25}$ | $B_{50}$ |
|---|---|---|---|---|
| I | 1.27 | 2.88 | 1.59 | 1.68 |
| J | 1.35 | 3.05 | 1.58 | 1.67 |

We claim:

1. A non-oriented magnetic material produced by hot-rolling a slab consisting essentially of ≦0.065% C, ≦0.10% Al, 0.31 to 3.15% Si, ≦0.020% O, ≦0.01% N and B being present in such amounts that the ratio of B/N is in the range of 0.50 to 2.50, and the rest being Fe and unavoidable impurities to obtain a hot-rolled sheet, subjecting the thus-obtained hot-rolled sheet to at least one cold-rolling step with intermediate annealing, when a plurality of steps is used, followed by a continuous annealing step to produce a non-oriented magnetic material.

2. A non-oriented magnetic material produced by hot-rolling a slab consisting essentially of ≦0.065% C, ≦0.10% Al, 0.31 to 3.15% Si, ≦0.020% O, ≦0.01% N and B being present in such amounts that the ratio of B/N is in the range of 0.50 to 2.50, and the rest being Fe and unavoidable impurities to obtain a hot-rolled sheet, subjecting the thus-obtained hot-rolled sheet to at least one cold-rolling step with intermediate annealing, when a plurality of steps is used, followed by a continuous annealing step and subjecting the sheet to a reannealing step to produce a non-oriented magnetic material.

3. A non-oriented magnetic material according to claim 1 or 2 which contains ≦2.00% Si.

4. A non-oriented magnetic material according to claim 1 or 2 wherein the ratio of B/N is 0.65–1.50.

* * * * *